US008421552B2

(12) United States Patent
Ando

(10) Patent No.: US 8,421,552 B2
(45) Date of Patent: Apr. 16, 2013

(54) HIGH-FREQUENCY SWITCH

(75) Inventor: Akira Ando, Urayasu (JP)

(73) Assignee: Soshin Electric Co., Ltd., Saku (JP)

( * ) Notice: Subject to any disclaimer, the term of this patent is extended or adjusted under 35 U.S.C. 154(b) by 318 days.

(21) Appl. No.: 12/992,716

(22) PCT Filed: Jun. 2, 2009

(86) PCT No.: PCT/JP2009/060012

§ 371 (c)(1),
(2), (4) Date: Nov. 15, 2010

(87) PCT Pub. No.: WO2009/148030

PCT Pub. Date: Dec. 10, 2009

(65) Prior Publication Data

US 2011/0057745 A1 Mar. 10, 2011

(30) Foreign Application Priority Data

Jun. 6, 2008 (JP) ..... 2008-149210

(51) Int. Cl.
*H01P 1/15* (2006.01)
*H01P 5/18* (2006.01)

(52) U.S. Cl.
USPC ..... 333/103; 333/109

(58) Field of Classification Search ..... 333/101, 333/103, 104, 109
See application file for complete search history.

(56) References Cited

U.S. PATENT DOCUMENTS 5,023,935 A * 6/1991 Vancraeynest ..... 455/80
5,193,218 A 3/1993 Shimo
6,070,059 A 5/2000 Kato et al.
6,847,829 B2 1/2005 Tanaka et al.
7,075,386 B2 7/2006 Kearns
7,138,885 B2 * 11/2006 Karlsson et al. ..... 333/103
7,546,089 B2 * 6/2009 Bellantoni ..... 455/73
8,089,329 B2 * 1/2012 Tsukahara ..... 333/103
2005/0221767 A1 10/2005 Suga et al.
2010/0253445 A1 10/2010 Ando
2011/0163792 A1 7/2011 Ando

FOREIGN PATENT DOCUMENTS

JP 60-174534 A1 9/1985
JP 01-033961 B2 7/1989
JP 06-058628 U1 8/1994
JP 2532122 B2 9/1996
JP 09-083206 A1 3/1997

(Continued)

OTHER PUBLICATIONS

U.S. Appl. No. 13/062,826, filed Apr. 8, 2011, Akira Ando.

*Primary Examiner* — Dean O Takaoka
(74) *Attorney, Agent, or Firm* — Burr & Brown

(57) ABSTRACT

Provided is a high-frequency switch formed by a first switch circuit connected in parallel to a first λ/4 signal transmission path for transmitting a transmission signal from a transmission terminal and a second switch circuit connected in parallel to a second λ/4 signal transmission path for transmitting a reception signal to a reception terminal. The high-frequency switch further includes a directivity coupler which has the first λ/4 signal transmission path as a constituent element and detects a reflected wave of the transmission signal. The directivity coupler includes: the first λ/4 signal transmission path; a λ/4 signal line arranged to oppose to the first λ/4 signal transmission path; a reflected wave output terminal connected to one end of the λ/4 signal line; and a terminal resistor connected to the other end of the λ/4 signal line.

15 Claims, 18 Drawing Sheets

FOREIGN PATENT DOCUMENTS

| | | | |
|---|---|---|---|
| JP | 10-335902 | A1 | 12/1998 |
| JP | 2830319 | B2 | 12/1998 |
| JP | 2962418 | B2 | 10/1999 |
| JP | 2003-037521 | A1 | 2/2003 |
| JP | 2005-065277 | A1 | 3/2005 |
| JP | 3627704 | B2 | 3/2005 |
| JP | 2005-295503 | A1 | 10/2005 |
| JP | 3823843 | B2 | 9/2006 |
| JP | 2009-152749 | A1 | 7/2009 |

* cited by examiner

HIGH-FREQUENCY SWITCH

TECHNICAL FIELD

The present invention relates to a high frequency switch for switching between high frequency signals, and more particularly to a high frequency switch suitable for use as an antenna switch connected to an antenna, e.g., a TDD (Time Division Duplex) switch or the like.

BACKGROUND ART

Conventional high frequency switches such as antenna switches include a microwave switch disclosed in Japanese Patent No. 2532122 and a transmission and reception switching device disclosed in Japanese Patent No. 2830319, for example.

The microwave switch disclosed in Japanese Patent No. 2532122 has PIN diodes inserted in series and parallel in a signal line. Forward currents are passed through the PIN diodes to turn them on, and the PIN diodes are reversely biased to turn them off, thereby switching between high frequency signals.

The transmission and reception switching device disclosed in Japanese Patent No. 2830319 employs a circuit scheme wherein a switch is constructed of transmission lines and PIN diodes or the like which are connected in series to the transmission lines, the transmission lines and the PIN diodes being connected parallel to a signal transmission line.

SUMMARY OF INVENTION

There are two types of transmission and reception switching schemes (a first transmission and reception switching scheme and a second transmission and reception switching scheme) using high frequency switches, as described below.

According to the first transmission and reception switching scheme, as shown in FIG. 17, a transmission amplifier 108 and an isolator 111 are connected to a transmission signal line 106 between a transceiver 100 and a transmission and reception antenna 102 (or via a bandpass filter 104), and a reception amplifier 112 is connected to a reception signal line 110 between the transceiver 100 and the transmission and reception antenna 102 (or via the bandpass filter 104). A high frequency switch 114 is connected to the junction between the transmission signal line 106 and the reception signal line 110.

According to the second transmission and reception switching scheme, as shown in FIG. 18, a transmission amplifier 108 is connected to a transmission signal line 106, and a reception amplifier 112 and a high frequency switch 114 are connected to a reception signal line 110. A circulator 116 is connected to the junction between the transmission signal line 106 and the reception signal line 110.

In the above high frequency switch, a feeding line such as a coaxial line is connected between the transceiver 100 and the antenna 102. After a transmission signal output from the transceiver 100 is carried by a travelling wave to the antenna 102, the transmission signal is radiated into air. In this case, if the antenna 102 and the feeding line become mismatched for some reason, the transmission signal is reflected at the antenna 102 and returns to the transceiver 100 as a reflected wave. Then, the communication cannot be made normally, which may also lead to malfunction or breakdown of the transceiver 100. Therefore, it is preferable to watch a reflected wave all the time. Also, it is preferable to watch the level of a travelling wave to control it so as to have an appropriate value.

For this purpose, it is considered that a directional coupler is inserted and connected in order to detect a reflected wave and a travelling wave of a transmission signal.

In the first transmission and reception switching scheme, for example, as shown in FIG. 17, a first directional coupler 120 is inserted and connected between the high frequency switch 114 and the bandpass filter 104, for detecting a reflected wave. Further, a second directional coupler 122 is inserted and connected between the transmission amplifier 108 and the isolator 111, for detecting a travelling wave.

In the second transmission and reception switching scheme, as shown in FIG. 18, a first directional coupler 120 is inserted and connected between the high frequency switch 114 and a terminating resistor 124, for detecting a reflected wave. Further, a second directional coupler 122 is inserted and connected between the transmission amplifier 108 and the circulator 116, for detecting a travelling wave.

In both of the first and second transmission and reception switching schemes, however, it is necessary to insert and connect two new electronic components of the first directional coupler 120 and the second directional coupler 122. Thus, the number of parts used in a system becomes large, and also the size thereof becomes large, which will lead to high production cost. Further, a transmission loss will become large.

In Japanese Patent No. 2532122 and Japanese Patent No. 2830319, there is no idea disclosed to detect a reflected wave (and a travelling wave). The switch or device disclosed in these patents can merely be used as a substitution for the high frequency switch 114 in the first or second transmission and reception switching scheme.

The present invention has been made in view of the above problems. It is an object of the present invention to provide a high frequency switch which can detect at least a reflected wave of a transmission signal even with a single high frequency switch, enhance the reduction in the number of parts used for a transmission system or a transceiving system with a reflected wave detection function, enhance the reduction in size, enhance the reduction in a production cost, and enhance the reduction in a transmission loss.

According to the present invention, a high frequency switch includes a first switch circuit connected parallel to a first signal transmission line for transmitting a transmission signal from a transmission terminal, and a second switch circuit connected parallel to a second signal transmission line for transmitting a reception signal to a reception terminal, the high frequency switch comprising a directional coupler having the first signal transmission line as a component thereof, for detecting at least a reflected wave of the transmission signal.

With the above arrangement, at least a reflected wave of a transmission signal can be detected even with a single high frequency switch. Also, it is possible to enhance the reduction in the number of parts used for a transmission system or a transceiving system with a reflected wave detection function, the reduction in size, the reduction in a production cost, and the reduction in a transmission loss.

According to the present invention, the directional coupler may further comprise a line disposed so as to face the first signal transmission line, a reflected wave output terminal connected to one end of the line, and a terminating resistor connected to another end of the line.

In the present invention, a third switch circuit may be connected parallel to a third signal transmission line connected between the transmission terminal and the first signal transmission line, the high frequency switch may further comprises a second directional coupler having the third signal transmission line as a component thereof, for detecting at least a travelling wave of the transmission signal. In this case, the directional coupler may further comprise a first line disposed so as to face the first signal transmission line, a reflected wave output terminal connected to one end of the first line, and a terminating resistor connected to another end of the first line, the second directional coupler may further comprises a second line disposed so as to face the third signal transmission line, a travelling wave output terminal connected to one end of the second line, and a second terminating resistor connected to another end of the second line.

In the present invention, the directional coupler may detect the reflected wave and a travelling wave of the transmission signal. In this case, the directional coupler may further comprise a line disposed so as to face the first signal transmission line, a reflected wave output terminal connected to one end of the line, and a travelling wave output terminal connected to another end of the line.

In the present invention, the first switch circuit may comprise a first transmission line and a circuit including one or more first PIN diode, the first transmission line and the circuit being connected in series to each other, and the second switch circuit may comprise a second transmission line and a circuit including one or more second PIN diode, the second transmission line and the circuit being connected in series to each other.

Further, the third switch circuit may comprise the third transmission line and a circuit including one or more third PIN diode, the third transmission line and the circuit being connected in series to each other.

Further, an electrical length of the above-mentioned signal transmission line is not limited, and a signal transmission line may have a length such as a 3λ/4 signal transmission line and a λ/4 signal transmission line. It is, however, preferable to use a λ/4 signal transmission line in view of the reduction in size or the like. Further, as to the above-mentioned line, either a 3λ/4 line or a λ/4 line may be used. It is, however, preferable to use a λ/4 line. Further, as to the above-mentioned transmission line, either a 3λ/4 transmission line or a λ/4 transmission line may be used. It is, however, preferable to use a λ/4 transmission line in view of the reduction in size or the like.

With the high frequency switch according to the present invention, as described above, at least a reflected wave of a transmission signal can be detected even with a single high frequency switch. Also, it is possible to enhance the reduction in the number of parts used for a transmission system or a transceiving system with a reflected wave detection function, the reduction in size, the reduction in a production cost, and the reduction in a transmission loss.

BRIEF DESCRIPTION OF DRAWINGS

FIG. 7 is a diagram showing an equivalent circuit of the first antenna switch when the first switch circuit is turned off and the second switch circuit is turned on;

FIG. 14 is a diagram showing an equivalent circuit of the fifth antenna switch when a first switch circuit and a fourth switch circuit are turned off and a second switch circuit and a third switch circuit are turned on;

DESCRIPTION OF EMBODIMENTS

Embodiments wherein a high frequency switch according to the present invention is applied, for example, to an antenna switch will be described below with reference to FIGS. 1 through 16. It is assumed that λ represents a wavelength corresponding to the central frequency of an operating frequency band of the switch, and refers to a wavelength in transmission lines described below.

Figure 1:
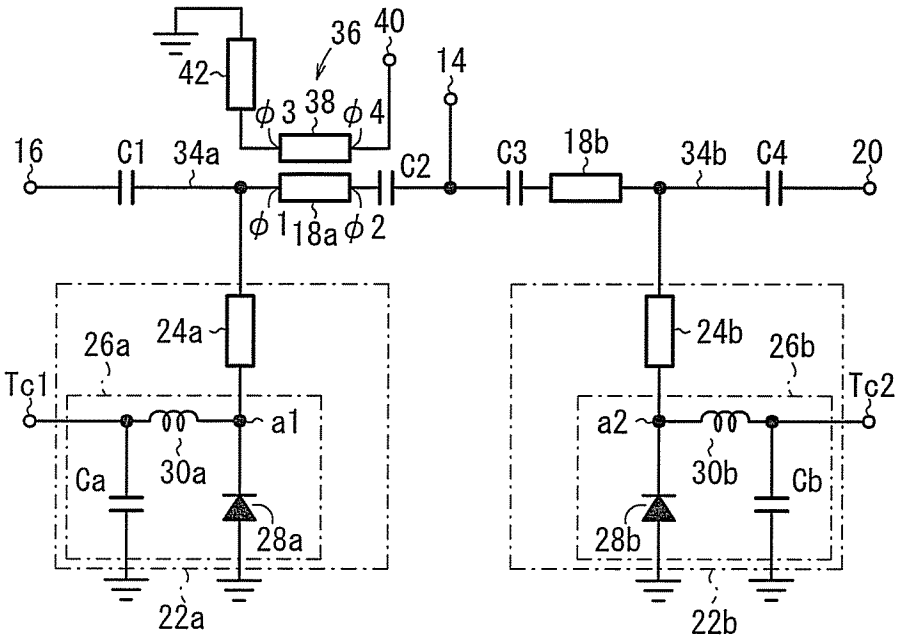
FIG. 1 is a circuit diagram showing a configuration of a first antenna switch.

As shown in FIG. 1, an antenna switch according to a first embodiment (hereinafter referred to as a first antenna switch 10A) comprises a first λ/4 signal transmission line 18*a* connected between an antenna connection terminal 14 and a transmission terminal 16, a second λ/4 signal transmission line 18*b* connected between the antenna connection terminal 14 and a reception terminal 20, a first switch circuit 22*a* connected parallel to the first λ/4 signal transmission line 18*a*, and a second switch circuit 22*b* connected parallel to the second λ/4 signal transmission line 18*b*. Capacitors C1 through C4 are connected respectively between the transmission terminal 16 and the first λ/4 signal transmission line 18*a*, between the first λ/4 signal transmission line 18*a* and the antenna connection terminal 14, between the antenna connection terminal 14 and the second λ/4 signal transmission line

18*b*, and between the second λ/4 signal transmission line 18*b* and the reception terminal 20. The capacitors C1 through C4 are capacitors for blocking currents for turning on and off PIN diodes, to be described later, and operate as a short circuit at high frequencies.

The first switch circuit 22*a* is connected between a signal line between the capacitor C1 and the first λ/4 signal transmission line 18*a* and GND (ground). The first switch circuit 22*a* comprises a series-connected circuit of a first λ/4 transmission line 24*a* and a first parallel resonant circuit 26*a* which are connected in series to each other at a first junction a1.

The first parallel resonant circuit 26*a* comprises a first PIN diode 28*a* connected between the first junction a1 and GND, a first inductor 30*a* connected between the first junction a1 and a first control terminal Tc1, and a first capacitor Ca connected between the first control terminal Tc1 and GND. The first capacitor Ca operates as a capacitor for blocking currents for turning on and off the first PIN diode 28*a*.

To the first control terminal Tc1, there are applied a forward bias voltage Vc1 for passing a forward current through the first PIN diode 28*a* to turn on the first PIN diode 28*a* and a reverse bias voltage Vc2 for reversely biasing the first PIN diode 28*a* to turn off the first PIN diode 28*a*.

As with the first switch circuit 22*a* described above, the second switch circuit 22*b* is connected between a signal line between the second λ/4 signal transmission line 18*b* and the capacitor C4 and GND (ground). The second switch circuit 22*b* comprises a series-connected circuit of a second λ/4 transmission line 24*b* and a second parallel resonant circuit 26*b* which are connected in series to each other at a second junction a2.

The second parallel resonant circuit 26*b* comprises a second PIN diode 28*b* connected between the second junction a2 and GND, a second inductor 30*b* connected between the second junction a2 and a second control terminal Tc2, and a second capacitor Cb connected between the second control terminal Tc2 and GND. The second capacitor Cb operates as a capacitor for blocking currents for turning on and off the second PIN diode 28*b*.

To the second control terminal Tc2, there are applied the forward bias voltage Vc1 for passing a forward current through the second PIN diode 28*b* to turn on the second PIN diode 28*b* and the reverse bias voltage Vc2 for reversely biasing the second PIN diode 28*b* to turn off the second PIN diode 28*b*.

When the forward bias voltage Vc1 is applied to the first control terminal Tc1, the reverse bias voltage Vc2 is applied to the second control terminal Tc2. When the reverse bias voltage Vc2 is applied to the first control terminal Tc1, the forward bias voltage Vc1 is applied to the second control terminal Tc2. The reverse bias voltage Vc2 which is applied to the first control terminal Tc1 and the reverse bias voltage Vc2 which is applied to the second control terminal Tc2 may have different voltage levels.

The first antenna switch 10A comprises a directional coupler 36 having the first λ/4 signal transmission line 18*a* as a component thereof. The directional coupler 36 detects a reflected wave of a transmission signal.

The directional coupler 36 comprises the above-mentioned first λ/4 signal transmission line 18*a*, a λ/4 line 38 disposed so as to face the first λ/4 signal transmission line 18*a*, a reflected wave output terminal 40 connected to one end of the λ/4 line 38, and a terminating resistor 42 connected to the other end of the λ/4 line 38. Another end of the terminating resistor 42 is grounded.

Figure 2:
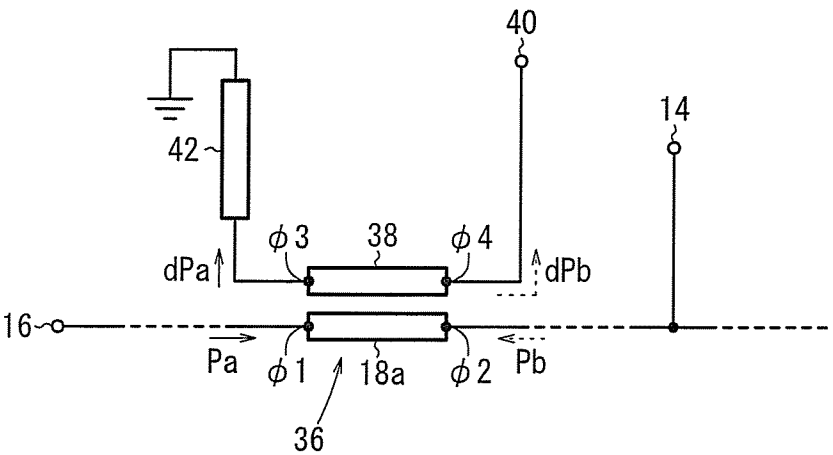
FIG. 2 is a diagram showing the manner in which a directional coupler operates.

The principles of operation of the directional coupler 36 will be described below with reference to FIG. 2. First, a first end ϕ1 to a fourth end ϕ4 of the directional coupler 36 will be defined as follows. The first end ϕ1 refers to an end of the first λ/4 signal transmission line 18*a* on the side of the transmission terminal 16, the second end ϕ2 refers to an end of the first λ/4 signal transmission line 18*a* on the side of the antenna connection terminal 14, the third end ϕ3 refers to an end of the λ/4 line 38 on the side of the transmission terminal 16, and the fourth end ϕ4 refers to an end of the λ/4 line 38 on the side of the antenna connection terminal 14.

When a travelling wave electric power Pa by a transmission signal from the transmission terminal 16 is applied to the first end ϕ1 of the directional coupler 36, a travelling wave is produced at the second end ϕ2, and also an electric wave (signal) is produced at the third end ϕ3, having an electric power dPa in proportion to the travelling wave electric power Pa. The wave is reflected at an antenna, and a reflected wave electric power Pb is applied to the second end ϕ2 of the directional coupler 36. Then, a reflected wave is produced at the first end ϕ1, and also an electric wave (signal) is produced at the fourth end ϕ4, having an electric power dPb in proportion to the reflected wave electric power Pb. In other words, a signal in proportion to the reflected wave electric power Pb is output from the reflected wave output terminal 40 that is connected to the fourth end ϕ4 of the directional coupler 36. Accordingly, the reflected wave can be detected.

Next, circuit operation of the first antenna switch 10A will be described below with reference to FIGS. 3 through 7.

The first switch circuit 22*a* will primarily be described below. When the forward bias voltage Vc1 is applied to the first control terminal Tc1, the first PIN diode 28*a* is turned on. At this time, the first switch circuit 22*a* is represented by an equivalent circuit shown in FIG. 3A. Specifically, a circuit comprising an inductance La and an ON resistance Ro of the first PIN diode 28*a* which are connected parallel to each other is connected in series between the first λ/4 transmission line 24*a* and GND.

Conversely, when the reverse bias voltage Vc2 is applied to the first control terminal Tc1, the first PIN diode 28*a* is turned off. At this time, the first switch circuit 22*a* is represented by an equivalent circuit shown in FIG. 3B. Specifically, a parallel resonant circuit comprising an inductance La, a parasitic capacitance Cf due to the depletion layer of the first PIN diode 28*a*, and a parallel resistance Rf of the first PIN diode 28*a* which are connected parallel to each other is connected in series between the first λ/4 transmission line 24*a* and GND.

In the first antenna switch 10A, the inductance La has a value established such that the central frequency fo of the first antenna switch 10A and the resonant frequency of the parallel resonant circuit that is made up of the parasitic capacitance Cf, the parallel resistance Rf, and the inductance La are in agreement with each other.

The ON resistance Ro is generally of about 1 ohm or less. Since the ON resistance Ro can be expressed as $Ro \ll 2\pi foLa$, the first switch circuit 22*a* can be represented by an equivalent circuit shown in FIG. 4A in the vicinity of the central frequency fo when the first PIN diode 28*a* is turned on, and can be represented by an equivalent circuit shown in FIG. 4B in the vicinity of the central frequency fo when the first PIN diode 28*a* is turned off.

Figure 5:
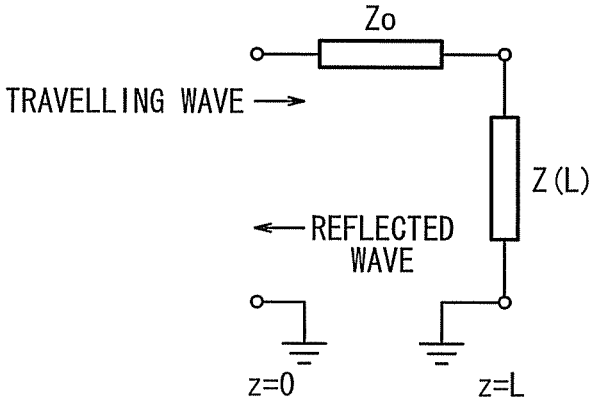
FIG. 5 is a diagram illustrative of the relationship between input and output impedances of a transmission line.

It is assumed that, as shown in FIG. 5, a transmission line z=L is terminated by the load of an impedance Z(L).

If the transmission line has a characteristic impedance Zo, a travelling wave is represented by $Ae^{-\gamma z}$, and a reflected wave is represented by $Be^{-\gamma z}$ (γ indicates a propagation constant), then a voltage V(z) and a current I(z) at a reference point z are expressed by the following equations:

$$V(z)=Ae^{-\gamma z}+Be^{\gamma z}$$

$$I(z)=(A/Zo)e^{-\gamma z}-(B/Zo)e^{\gamma z}$$

Therefore, the impedance Z(L) at z=L is expressed by the following equation:

$$Z(L) = V(L)/I(L)$$
$$= Zo\{(Ae^{-\gamma L} + Be^{\gamma L})/(Ae^{-\gamma L} - Be^{\gamma L})\}$$

A reflection coefficient Γ(L) has a relationship expressed by the following equation (a):

$$\Gamma(L) = (Be^{\gamma L})/(Ae^{-\gamma L}) \quad \text{(a)}$$
$$= (B/A)e^{2\gamma L}$$
$$= \{Z(L) - Zo\}/\{Z(L) + Zo\}$$

An impedance Z(0) of the load as seen at z=0 is expressed by the following equation (b):

$$Z(0)=Zo\{(A+B)/(A-B)\} \quad \text{(b)}$$

From the equation (a), $$B/A=[\{Z(L)-Zo\}/\{Z(L)+Zo\}]e^{-2\gamma L}$$

By substituting this equation into the equation (b), the following equation (c) is obtained:

$$Z(0)/Zo=\{Z(L)+Zo \tanh \gamma L\}/\{Zo+Z(L)\tanh \gamma L\} \quad \text{(c)}$$

where γ=α+jβ (α represents an attenuation constant and β a phase constant expressed by β=2π/λ).

Since α=0 and γ=jβ for a lossless line, the equation (c) can be modified into the following equation (d):

$$Z(0)/Zo=\{Z(L)+jZo \tan \gamma L\}/\{Zo+jZ(L)\tan \beta L\} \quad \text{(d)}$$

By substituting L=λ/4 into the equation (d), the following equation (e) is obtained:

$$Z(0)/Zo=Zo/Z(L)$$

$$Z(0)=Zo^2/Z(L) \quad \text{(e)}$$

Inasmuch as Z(L) is a low resistance of about 1 ohm or less when the first PIN diode 28*a* is turned on, the impedance (in this case, Z(0)) of the first λ/4 transmission line 24*a* on the signal line side is of a large value, and the signal line is ideally in an open state, as can be understood from the equation (e). Conversely, inasmuch as Z(L) is a high resistance of about 10 k ohms or more when the first PIN diode 28*a* is turned off, the impedance (in this case, Z(0)) of the first λ/4 transmission line 24*a* on the signal line side is of a small value, and the signal line is ideally in a short-circuited state, as can be understood from the equation (e).

Figure 6:
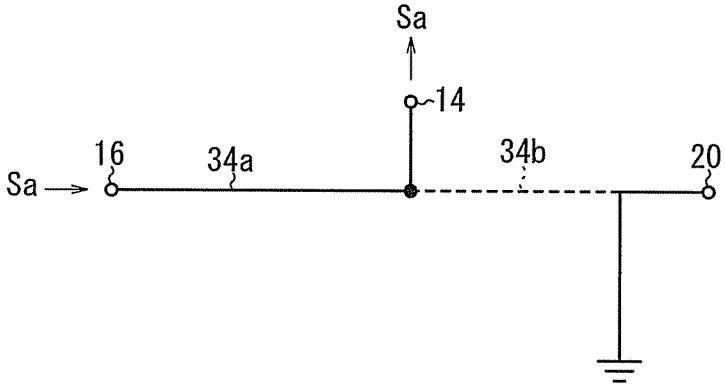
FIG. 6 is a diagram showing an equivalent circuit of the first antenna switch when the first switch circuit is turned on and a second switch circuit is turned off.

Therefore, when the forward bias voltage Vc1 is applied to the first control terminal Tc1, turning on the first PIN diode 28*a*, and the reverse bias voltage Vc2 is applied to the second control terminal Tc2, turning off the second PIN diode 28*b*, the first antenna switch 10A is represented by an equivalent circuit shown in FIG. 6 wherein only the transmission terminal 16 is connected to the antenna connection terminal 14 at high frequencies. A transmission signal Sa supplied to the transmission terminal 16 is thus transmitted via the antenna connection terminal 14. In other words, a first signal line 34*a* from the transmission terminal 16 to the antenna connection terminal 14 serves as a signal transmission side, and a second signal line 34*b* from the reception terminal 20 to the antenna connection terminal 14 serves as a signal cutoff side.

Figure 7:
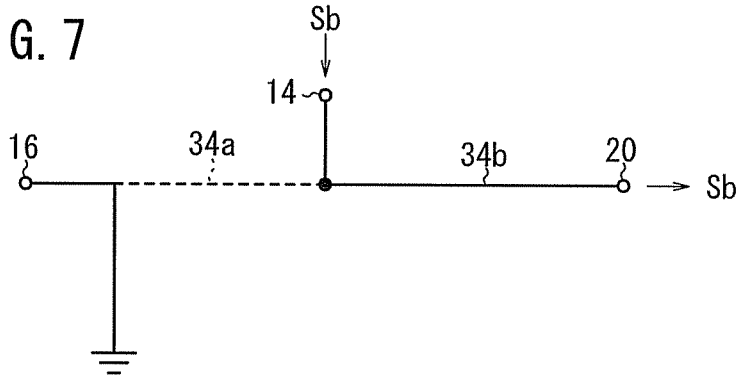

Conversely, when the reverse bias voltage Vc2 is applied to the first control terminal Tc1, turning off the first PIN diode 28*a*, and when the forward bias voltage Vc1 is applied to the second control terminal Tc2, turning on the second PIN diode 28*b*, the first antenna switch 10A is represented by an equivalent circuit shown in FIG. 7 wherein only the reception terminal 20 is connected to the antenna connection terminal 14 at high frequencies. A reception signal Sb received by the antenna is thus supplied to the antenna connection terminal 14 and output from the reception terminal 20. In other words, the first signal line 34*a* from the transmission terminal 16 to the antenna connection terminal 14 serves as a signal cutoff side, and the second signal line 34*b* from the reception terminal 20 to the antenna connection terminal 14 serves as a signal transmission side.

Figure 3A:
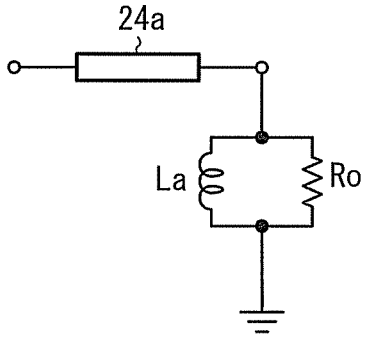
FIG. 3A is a diagram showing an equivalent circuit of a first switch circuit of the first antenna switch when a first PIN diode is turned on, and FIG. 3B is a diagram showing an equivalent circuit of the first switch circuit when the first PIN diode is turned off.
Figure 3B:
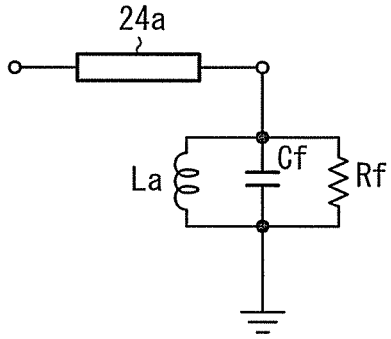
Figure 4A:
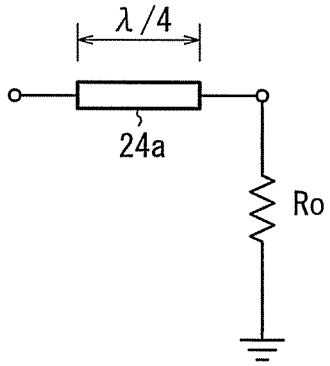
FIG. 4A is a diagram showing an equivalent circuit of the first switch circuit in the vicinity of a central frequency when the first PIN diode is turned on, and FIG. 4B is a diagram showing an equivalent circuit of the first switch circuit in the vicinity of a central frequency when the first PIN diode is turned off.
Figure 4B:
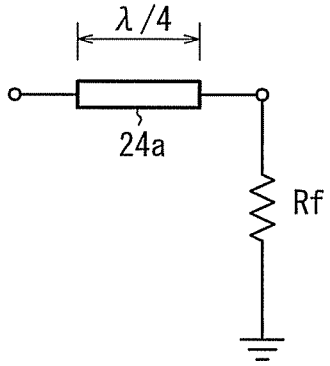

If the first parallel resonant circuit 26*a* is dispensed with and only the first PIN diode 28*a* is connected, then the first switch circuit 22*a* is not represented by the equivalent circuit shown in FIG. 4B in the vicinity of the central frequency fo when the first PIN diode 28*a* is turned off, but the parasitic capacitance Cf remains, as shown in FIG. 3B, shifting the resonant frequency into a low frequency range. As a result, the phase characteristic of the first λ/4 transmission line 24*a* suffers an error, thereby causing a loss.

With the first antenna switch 10A, the constant of the first inductor 30*a* of the first parallel resonant circuit 26*a* is adjusted to equalize the resonant frequency of the first parallel resonant circuit 26*a* at the time the first PIN diode 28*a* is turned off with the central frequency fo of the first antenna switch 10A. Similarly, the constant of the second inductor 30*b* of the second parallel resonant circuit 26*b* is adjusted to equalize the resonant frequency of the second parallel resonant circuit 26*b* at the time the second PIN diode 28*b* is turned off with the central frequency fo of the first antenna switch 10A.

Since the ON resistance Ro of the PIN diode is expressed as Ro<<2πfoLa, only the ON resistance Ro is connected to GND of the first λ/4 transmission line 24*a* when the first PIN diode 28*a* is turned on, and only the parallel resistance Rf is connected to GND of the first λ/4 transmission line 24*a* when the first PIN diode 28*a* is turned off, as shown in FIGS. 4A and 4B. Consequently, the resonant frequencies of the first λ/4 transmission line 24*a* at the time the first PIN diode 28*a* is turned on and off do not deviate from each other.

With the first antenna switch 10A, therefore, the phase characteristics of the first λ/4 transmission line 24*a* and the second λ/4 transmission line 24*b* do not suffer an error, and the passband at the time the switch circuits are turned on and the isolation band at the time the switch circuits are turned off are held in conformity with each other. In other words, the first antenna switch 10A is capable of appropriately minimizing the insertion loss caused when the switch circuits are turned on and maximizing the isolation provided when the switch circuits are turned off in a band that is used by the antenna switch. As a result, the loss of a transmission signal caused in the switch circuits is reduced, and an appropriate amount of attenuation at the time the switch circuits are turned off is secured.

In particular, the first antenna switch 10A has the directional coupler 36 having the first λ/4 signal transmission line 18*a* as a component thereof. Thus, when an output transmission signal is reflected at an antenna, a signal in proportion to a reflected wave can be read out at the reflected wave output terminal 40 of the directional coupler 36, so that the reflected wave can be detected. In this case, it is only necessary that the λ/4 line 38 is disposed so as to face the first λ/4 signal transmission line 18*a*. Therefore, a reflected wave of a transmission signal can be detected without increasing the number of parts used.

Thus, since the first antenna switch 10A can detect a reflected wave of a transmission signal even with a single antenna switch, it is possible to enhance the reduction in the number of parts used for a transmission system or a transceiving system with a reflected wave detection function, and the reduction in size thereof. Also, it is further possible to enhance the reduction in a production cost and in a transmission loss.

Next, an antenna switch according to a second embodiment (hereinafter referred to as a second antenna switch 10B) will be described below with reference to FIG. 8.

Figure 8:
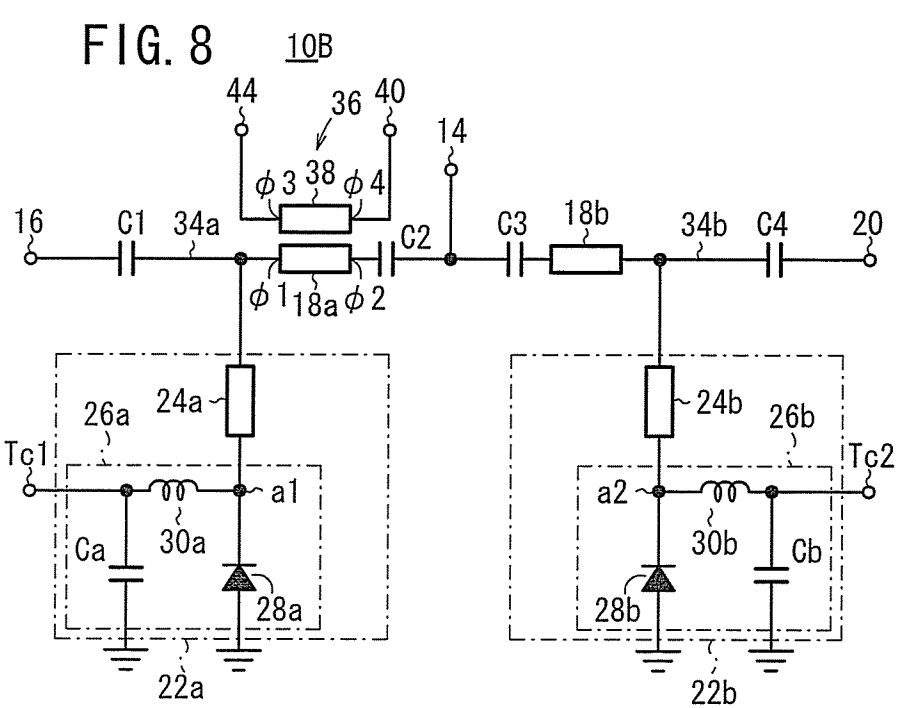
FIG. 8 is a circuit diagram showing a configuration of a second antenna switch.

As shown in FIG. 8, the second antenna switch 10B is of a configuration substantially similar to the first antenna switch 10A described above, but is different in a configuration of a directional coupler 36 as follows:

The directional coupler 36 comprises the first λ/4 signal transmission line 18*a*, and the λ/4 line 38 disposed so as to face the first λ/4 signal transmission line 18*a*. The third end ϕ3 (an end of the λ/4 line 38 on the side of the transmission terminal 16) is connected to a travelling wave output terminal 44, and the fourth end ϕ4 an end of the λ/4 line 38 on the side of the antenna connection terminal 14) is connected to the reflected wave output terminal 40.

Thus, a signal in proportion to the travelling wave electric power Pa (see FIG. 2) is output from the travelling wave output terminal 44 connected to the third end ϕ3 of the directional coupler 36. Also, a signal in proportion to the reflected wave electric power Pb is output from the reflected wave output terminal 40 connected to the fourth end ϕ4 of the directional coupler 36. Therefore, a reflected wave and a travelling wave of a transmission signal can be detected.

An antenna switch according to a third embodiment (hereinafter referred to as a third antenna switch 10C) will be described below with reference to FIG. 9.

Figure 9:
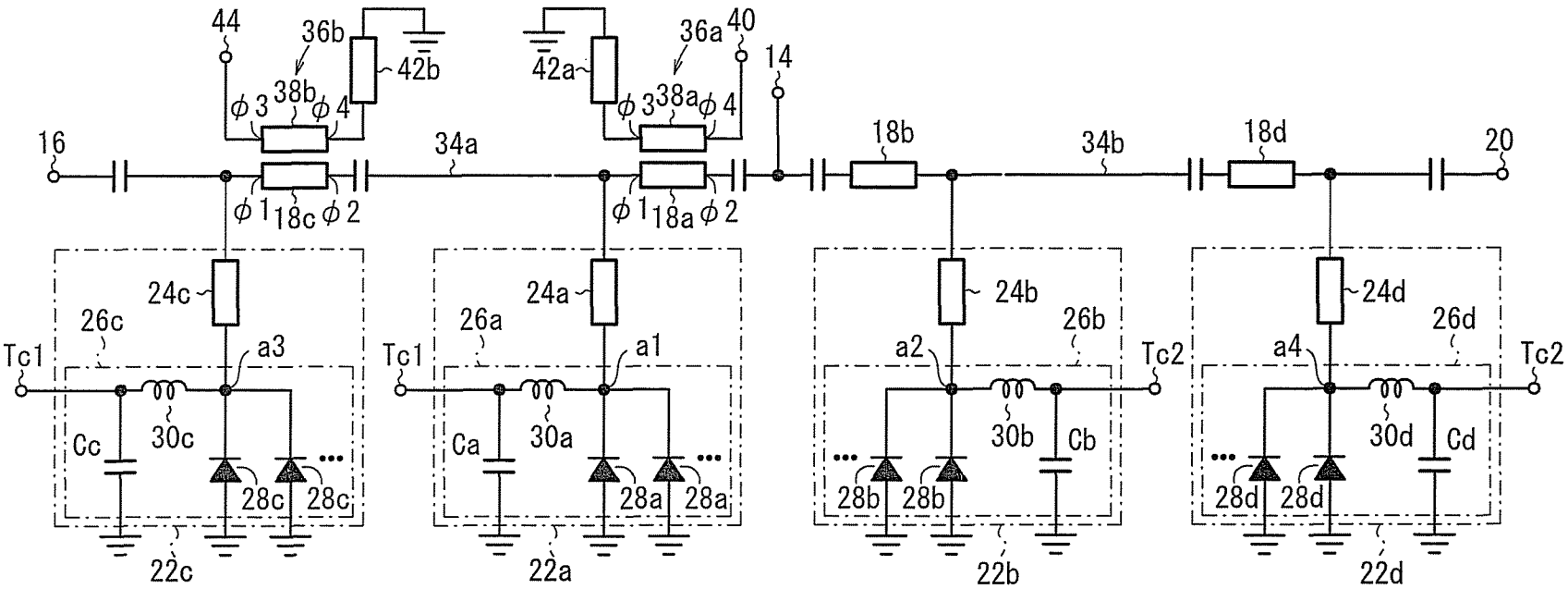
FIG. 9 is a circuit diagram showing a configuration of a third antenna switch.

As shown in FIG. 9, the third antenna switch 10C is of a configuration substantially similar to the first antenna switch 10A described above, but is different therefrom as follows:

A third λ/4 signal transmission line 18*c* is connected between the transmission terminal 16 and the first λ/4 signal transmission line 18*a*, and a fourth λ/4 signal transmission line 18*d* is connected between the reception terminal 20 and the second λ/4 signal transmission line 18*b*.

A third switch circuit 22*c* is connected in association with the third λ/4 signal transmission line 18*c*, and a fourth switch circuit 22*d* is connected in association with the fourth λ/4 signal transmission line 18*d*.

Furthermore, a first parallel resonant circuit 26*a* of a first switch circuit 22*a* has a plurality of parallel first PIN diodes 28*a*, and a second parallel resonant circuit 26*b* of a second switch circuit 22*b* has a plurality of parallel second PIN diodes 28*b*. Similarly, a third parallel resonant circuit 26*c* of a third switch circuit 22*c* has a plurality of parallel third PIN diodes 28*c*, and a fourth parallel resonant circuit 26*d* of a fourth switch circuit 22*d* has a plurality of parallel fourth PIN diodes 28*d*.

In this case also, each of the constants of the first inductor 30*a* of the first parallel resonant circuit 26*a* and a third inductor 30*c* of the third parallel resonant circuit 26*c* is adjusted to equalize the resonant frequency of the first parallel resonant circuit 26*a* at the time the first PIN diode 28*a* is turned off and the resonant frequency of the third parallel resonant circuit 26*c* at the time the third PIN diode 28*c* is turned off with the central frequency of the third antenna switch 10C.

Similarly, each of the constants of the second inductor 30*b* of the second parallel resonant circuit 26*b* and a fourth inductor 30*d* of the fourth parallel resonant circuit 26*d* is adjusted to equalize the resonant frequency of the first parallel resonant circuit 26*a* at the time the second PIN diode 28*b* is turned off and the resonant frequency of the fourth parallel resonant circuit 26*d* at the time the fourth PIN diode 28*d* is turned off with the central frequency of the third antenna switch 10C.

When the first switch circuit 22*a* and the third switch circuit 22*c* are turned on, i.e., when all the first PIN diodes 28*a* and the third PIN diodes 28*c* are turned on, each resistance between the first junction a1 and GND and between the third junction a3 and GND is represented by a resistance which is lower than one ON resistance. As can be understood from the equation (e) above, each impedance at the end on the first signal line 34*a* side of the first λ/4 transmission line 24*a* and at the end on the first signal line 34*a* side of the third λ/4 transmission line 24*c* is an impedance higher than with one ON resistance. The switch circuits thus approach an ideal open state.

Conversely, when the first switch circuit 22*a* and the third switch circuit 22*c* are turned off, i.e., when all the first PIN diodes 28*a* and the third PIN diodes 28*c* are turned off, only parallel resistances, which are high, are connected between the first junction a1 and GND and between the third junction a3 and GND. As can be understood from the equation (e) above, each impedance at the end on the first signal line 34*a* side of the first λ/4 transmission line 24*a* and at the end on the first signal line 34*a* side of the third λ/4 transmission line 24*c* is a low impedance depending on the high resistance. In other words, the insertion loss of the switch circuits upon signal transmission can further be reduced.

The third antenna switch 10C comprises the first directional coupler 36*a* and a second directional coupler 36*b*. The first directional coupler 36*a* has the first λ/4 signal transmission line 18*a* as a component thereof, for detecting a reflected wave of a transmission signal. The second directional coupler 36*b* has the third λ/4 signal transmission line 18*c* as a component thereof, for detecting a travelling wave of a transmission signal.

The first directional coupler 36*a* comprises the above-mentioned first λ/4 signal transmission line 18*a*, a first λ/4 line 38*a* disposed so as to face the first λ/4 signal transmission line 18*a*, a reflected wave output terminal 40 connected to one end (fourth end ϕ4) of the first λ/4 line 38*a*, and a first terminating resistor 42*a* connected to the other end (third end ϕ3) of the first λ/4 line 38*a*.

The second directional coupler 36*b* comprises the above-mentioned third λ/4 signal transmission line 18*c*, a second λ/4 line 38*b* disposed so as to face the third λ/4 signal transmission line 18*c*, a travelling wave output terminal 44 connected to one end (third end ϕ3) of the second λ/4 line 38*b*, and a second terminating resistor 42*b* connected to the other end (fourth end ϕ4) of the second λ/4 line 38*b*. Other ends of the first terminating resistor 42*a* and the second terminating resistor 42*b* are grounded.

In this case, a signal in proportion to the travelling wave electric power Pa (see FIG. 2) is output from the travelling wave output terminal 44 connected to the third end ϕ3 of the second directional coupler 36*b*. Also, a signal in proportion to the reflected wave electric power Pb is output from the reflected wave output terminal 40 connected to the fourth end ϕ4 of the first directional coupler 36*a*. Therefore, a reflected wave and a travelling wave of a transmission signal can be detected.

Further, even if the characteristics of a monitor circuit (reflected wave detection circuit) connected to the reflected wave output terminal 40 and the characteristics of a monitor circuit (travelling wave detection circuit) connected to the travelling wave output terminal 44 are different from each other, each of the output characteristics of the first directional coupler 36*a* and the second directional coupler 36*b* can be set independently to be in accordance with the characteristics of each of the monitor circuits. Therefore, the directional couplers can be designed more freely.

An antenna switch according to a fourth embodiment (hereinafter referred to as a fourth antenna switch 10D) will be described below with reference to FIG. 10.

Figure 10:
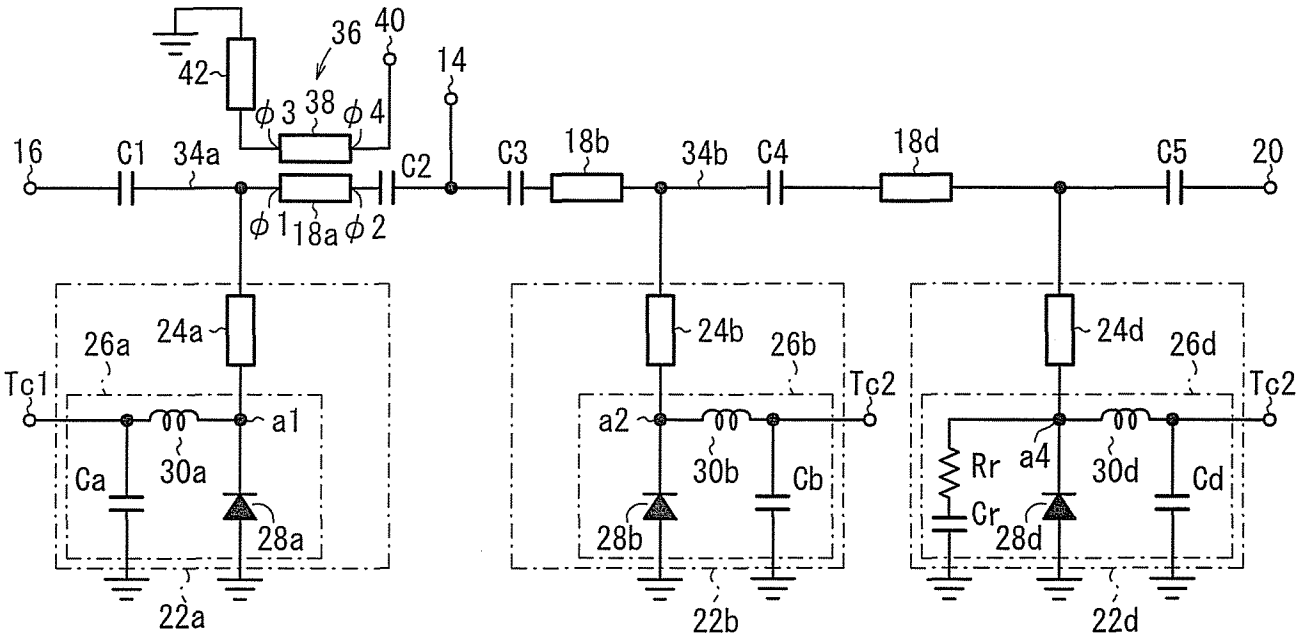
FIG. 10 is a circuit diagram showing a configuration of a fourth antenna switch.
Figure 11A:
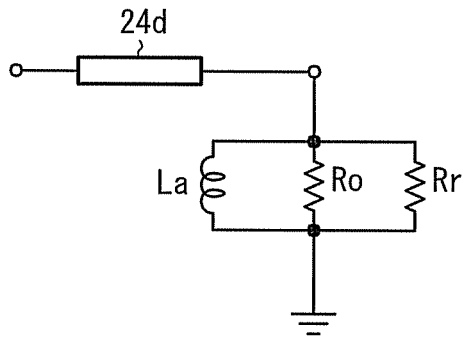
FIG. 11A is a diagram showing an equivalent circuit of a fourth switch circuit of the fourth antenna switch when a fourth PIN diode is turned on, and FIG. 11B is a diagram showing an equivalent circuit of the fourth switch circuit when the fourth PIN diode is turned off.
Figure 11B:
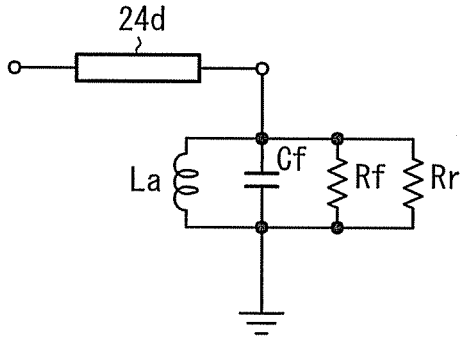

As shown in FIG. 10, the fourth antenna switch 10D is of a configuration substantially similar to the first antenna switch 10A described above, but is different therefrom as follows:

Specifically, the fourth λ/4 signal transmission line 18*d* is connected between the reception terminal 20 and the second λ/4 signal transmission line 18*b*, and a fourth switch circuit 22*d* is connected in association with the fourth λ/4 signal transmission line 18*d*.

As with the second switch circuit 22*b*, the fourth switch circuit 22*d* is connected between a signal line between the fourth λ/4 signal transmission line 18*d* and the capacitor C5 and GND (ground). The fourth switch circuit 22*d* comprises a series-connected circuit of the fourth λ/4 transmission line 24*d* and a fourth parallel resonant circuit 26*d* which are connected in series to each other at a fourth junction a4.

The fourth parallel resonant circuit 26*d* comprises a fourth PIN diode 28*d* connected between the fourth junction a4 and GND, the fourth inductor 30*d* connected between the fourth junction a4 and the second control terminal Tc2, and a fourth capacitor Cd connected between the second control terminal Tc2 and GND. The fourth capacitor Cd operates as a capacitor for blocking currents for turning on and off the fourth PIN diode 28*d*.

The fourth switch circuit 22*d* also includes a series-connected circuit of a resistor Rr for forming a reception terminating resistance and a capacitor Cr, connected parallel to the fourth PIN diode 28*d*. The capacitor Cr operates as a capacitor for blocking currents for turning on and off the fourth PIN diode 28*d*.

Operation of the fourth switch circuit 22*d* will primarily be described below. In the fourth switch circuit 22*d*, when the forward bias voltage Vc1 is applied to the second control terminal Tc2, the fourth PIN diode 28*d* is turned on. At this time, the fourth switch circuit 22*d* is represented by an equivalent circuit shown in FIG. 11A. Specifically, a circuit comprising an inductance La, an ON resistance Ro of the fourth PIN diode 28*d*, and the resistor Rr for forming a reception terminating resistance which are connected parallel to each other is connected in series between the fourth λ/4 transmission line 24*d* and GND.

Conversely, when the reverse bias voltage Vc2 is applied to the second control terminal Tc2, the fourth PIN diode 28*d* is turned off. At this time, the fourth switch circuit 22*d* is represented by an equivalent circuit shown in FIG. 11B. Specifically, a parallel resonant circuit comprising an inductance La, a parasitic capacitance Cf due to the depletion layer of the fourth PIN diode 28*d*, a parallel resistance Rf of the fourth PIN diode 28*d*, and the resistor Rr for forming a reception terminating resistance which are connected parallel to each other is connected in series between the fourth λ/4 transmission line 24*d* and GND.

In this case, the inductance La also has a value established such that the central frequency fo of the fourth antenna switch 10D and the resonant frequency of the parallel resonant circuit that is made up of the parasitic capacitance Cf, the parallel resistance Rf, and the inductance La are in agreement with each other.

As described above, the fourth switch circuit 22*d* is of a configuration including the parallel-connected resistor Rr for forming a reception terminating resistance. Since the ON resistance Ro and the resistor Rr have a magnitude relationship of Ro<<Rr, the resistor Rr does not affect the operation of the fourth switch circuit 22*d* when the fourth PIN diode 28*d* is turned on. Since the parallel resistance Rf and the resistor Rr have a magnitude relationship of Rf>>Rr, the impedance on the signal line side is determined by the resistor Rr.

Specifically, if the characteristic impedance of the fourth λ/4 transmission line 24*d* is of 50 ohms and the resistor Rr for forming a reception terminating resistance is of 50 ohms, then the combined resistance (Rf//Rr) of the parallel resistance Rf (e.g., 10 k ohms) and the resistor Rr is of 49.751 ohms. The impedance of the fourth λ/4 transmission line 24*d* on the signal line side is terminated with 50×50/49.751=50.250 ohms according to the equation (e) (the terminating resistance is of 50.250 ohms). Actually, the value of the resistor Rr is determined so that the terminating resistance is of 50 ohms, for example.

When the fourth PIN diode 28*d* is turned on, if the ON resistance Ro=1 ohm, then since the combined resistance (Ro//Rr) of the ON resistance Ro and the resistor Rr is of 0.9804 ohm, the impedance of the third λ/4 transmission line 24*c* on the signal line side is of 50×50/0.9804=2550 ohms according to the equation (e).

Figure 12:
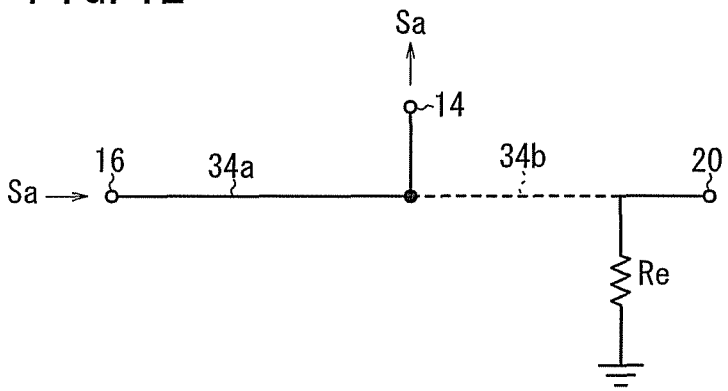
FIG. 12 is a diagram showing an equivalent circuit of the fourth antenna switch when a first switch circuit is turned on and a second switch circuit and the fourth switch circuit are turned off.

Therefore, when the forward bias voltage Vc1 is applied to the first control terminal Tc1, turning on the first PIN diode 28*a*, and the reverse bias voltage Vc2 is applied to the second control terminal Tc2, turning off the second PIN diode 28*b* and the fourth PIN diode 28*d*, the fourth antenna switch 10D is represented by an equivalent circuit shown in FIG. 12 wherein only the transmission terminal 16 is connected to the antenna connection terminal 14 at high frequencies, and a terminating resistor Re of 50 ohms, for example, is connected to the reception terminal 20. A transmission signal Sa supplied to the transmission terminal 16 is thus transmitted via the antenna connection terminal 14. In other words, the first signal line 34*a* from the transmission terminal 16 to the antenna connection terminal 14 serves as a signal transmission side, and the second signal line 34*b* from the reception terminal 20 to the antenna connection terminal 14 serves as a signal cutoff side.

If the fourth switch circuit 22*d* were not present, then the impedance of the second λ/4 transmission line 24*b* on the signal line side would be of a small value, and the signal line is ideally in a short-circuited state, as described above. In other words, since the impedance on the receiver side when the switch is turned off is of 0 ohm, resulting in total reflection, the reception amplifier connected to the reception terminal 20 may become unstable in operation.

Inasmuch as the fourth antenna switch 10D includes the fourth switch circuit 22*d*, the impedance on the receiver side when the switch is turned off is of the value of the terminating resistor Re, e.g., 50 ohms, thereby allowing the fourth antenna switch 10D to achieve impedance matching with other circuits. Therefore, the reception amplifier connected to the reception terminal 20 is rendered stable in operation.

Conversely, when the reverse bias voltage Vc2 is applied to the first control terminal Tc1, turning off the first PIN diode 28*a*, and the forward bias voltage Vc1 is applied to the second control terminal Tc2, turning on the second PIN diode 28*b* and the fourth PIN diode 28*d*, the fourth antenna switch 10D is represented by the equivalent circuit shown in FIG. 7 wherein only the reception terminal 20 is connected to the antenna connection terminal 14 at high frequencies, and a reception signal Sb received by the antenna is thus supplied to the antenna connection terminal 14 and output from the reception terminal 20. In other words, the first signal line 34*a* from the transmission terminal 16 to the antenna connection terminal 14 serves as a signal cutoff side, and the second signal line 34*b* from the reception terminal 20 to the antenna connection terminal 14 serves as a signal transmission side. Therefore, the resistor Rr does not affect reception of the signal.

As with the first antenna switch 10A, the fourth antenna switch 10D comprises the directional coupler 36 having the first λ/4 signal transmission line 18*a* as a component thereof. Thus, a signal in proportion to the reflected wave electric power Pb is output from the reflected wave output terminal 40 that is connected to the fourth end ϕ4 of the directional coupler 36. Accordingly, the reflected wave can be detected.

An antenna switch according to a fifth embodiment (hereinafter referred to as a fifth antenna switch 10E) will be described below with reference to FIG. 13.

The fifth antenna switch 10E is of a configuration which is substantially similar to the fourth antenna switch 10D described above, but is different therefrom as follows:

The fifth antenna switch 10E has the third λ/4 signal transmission line 18*c* connected between the first λ/4 signal transmission line 18*a* and the transmission terminal 16 and the third switch circuit 22*c* connected parallel to the third λ/4 signal transmission line 18*c*.

The third switch circuit 22*c* is connected between a signal line between the third λ/4 signal transmission line 18*c* and a capacitor C1 and GND (ground). The third switch circuit 22*c* comprises a series-connected circuit of the single third λ/4 transmission line 24*c* and the third parallel resonant circuit 26*c* which are connected in series to each other at the third junction a3.

The third parallel resonant circuit 26*c* comprises a third PIN diode 28*c* connected between the third junction a3 and GND, the third inductor 30*c* connected between the third junction a3 and a first control terminal Tc1, and a third capacitor Cc connected between the first control terminal Tc1 and GND. The third capacitor Cc operates as a capacitor for blocking currents for turning on and off the third PIN diode 28*c*.

The third switch circuit 22*c* also includes a series-connected circuit of a resistor Rt for forming a transmission terminating resistance and a capacitor Ct, which is connected parallel to the third PIN diode 28*c*.

The third switch circuit 22*c* is thus of a configuration identical to the fourth switch circuit 22*d* on the receiver side.

Therefore, when the forward bias voltage Vc1 is applied to the first control terminal Tc1, turning on the first PIN diode 28*a* and the third PIN diode 28*c*, and the reverse bias voltage Vc2 is applied to the second control terminal Tc2, turning off the second PIN diode 28*b* and the fourth PIN diode 28*d*, the fifth antenna switch 10E is represented by the equivalent circuit shown in FIG. 12 wherein only the transmission terminal 16 is connected to the antenna connection terminal 14 at high frequencies, and a terminating resistor of 50 ohms, for example, is connected to the reception terminal 20. In this case, the impedance on the receiver side when the switch is turned off is of the value of the terminating resistor Re, e.g., 50 ohms, thereby allowing the fifth antenna switch 10E to achieve impedance matching with other circuits. Therefore, the reception amplifier connected to the reception terminal 20 is rendered stable in operation.

Figure 14:
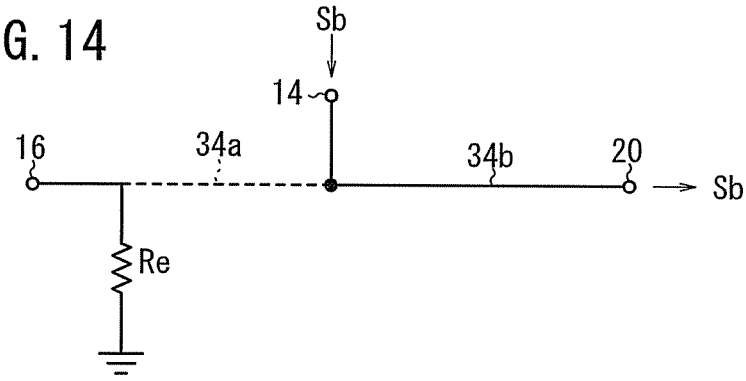

Conversely, when the reverse bias voltage Vc2 is applied to the first control terminal Tc1, turning off the first PIN diode 28*a* and the third PIN diode 28*c*, and the forward bias voltage Vc1 is applied to the second control terminal Tc2, turning on the second PIN diode 28*b* and the fourth PIN diode 28*d*, the fifth antenna switch 10E is represented by an equivalent circuit shown in FIG. 14 wherein only the reception terminal 20 is connected to the antenna connection terminal 14 at high frequencies, and a terminating resistor Re of, for example, 50 ohms is connected to the transmission terminal 16. In this case, the impedance on the transmitter side when the switch is turned off is of the value of the terminating resistor Re, e.g., 50 ohms, thereby allowing the fifth antenna switch 10E to achieve impedance matching with other circuits.

Figure 13:
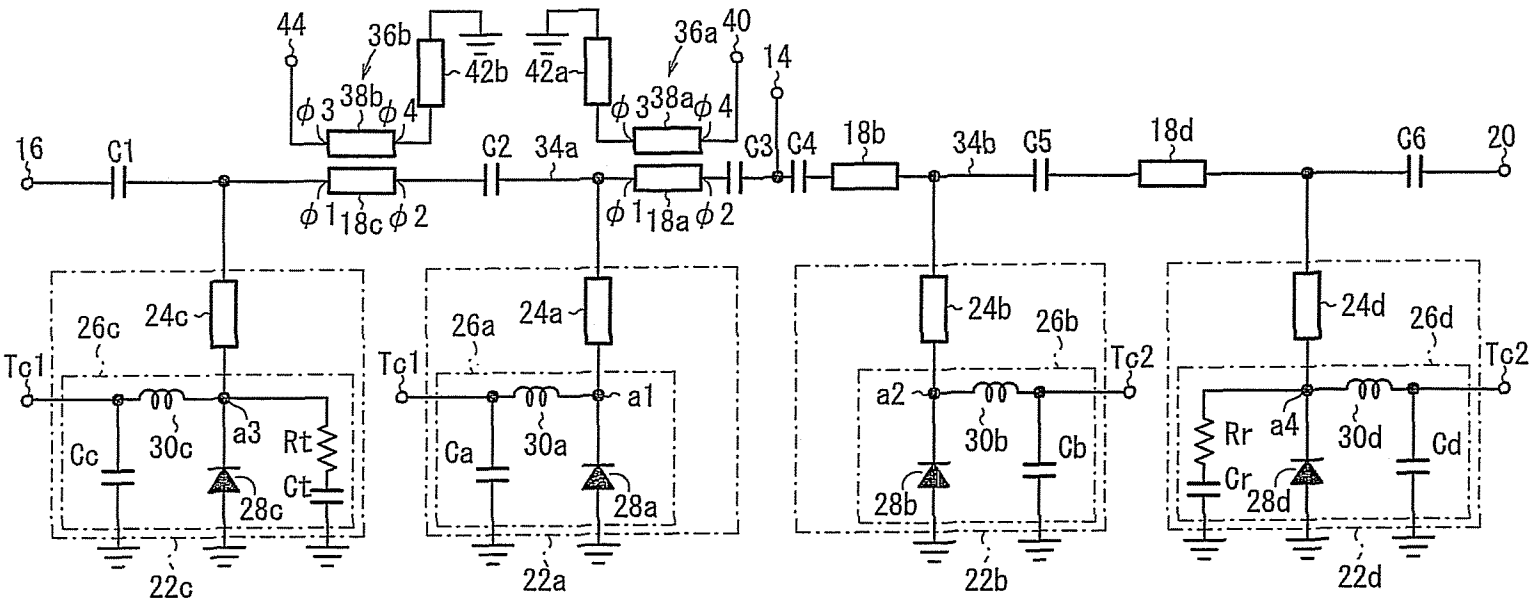
FIG. 13 is a circuit diagram showing a configuration of a fifth antenna switch.

As with the above-mentioned third antenna switch 10C, the fifth antenna switch 10E shown in FIG. 13 comprises the first directional coupler 36*a* and the second directional coupler 36*b*. The first directional coupler 36*a* has the first λ/4 signal transmission line 18*a* as a component thereof, for detecting a reflected wave of a transmission signal. The second directional coupler 36*b* has the third λ/4 signal transmission line 18*c* as a component thereof, for detecting a travelling wave of a transmission signal.

Thus, a signal in proportion to the travelling wave electric power Pa is output from the travelling wave output terminal 44 connected to the third end ϕ3 of the second directional coupler 36*b*. Also, a signal in proportion to the reflected wave electric power Pb is output from the reflected wave output terminal 40 connected to the fourth end ϕ4 of the first directional coupler 36*a*. Therefore, a reflected wave and a travelling wave of a transmission signal can be detected.

In the above-mentioned first through fifth antenna switches 10A through 10E, the central frequency fo of the operating frequency band has mainly been described. Actually, the above advantages are offered at each of the frequencies contained in the operating frequency band.

Figure 15:
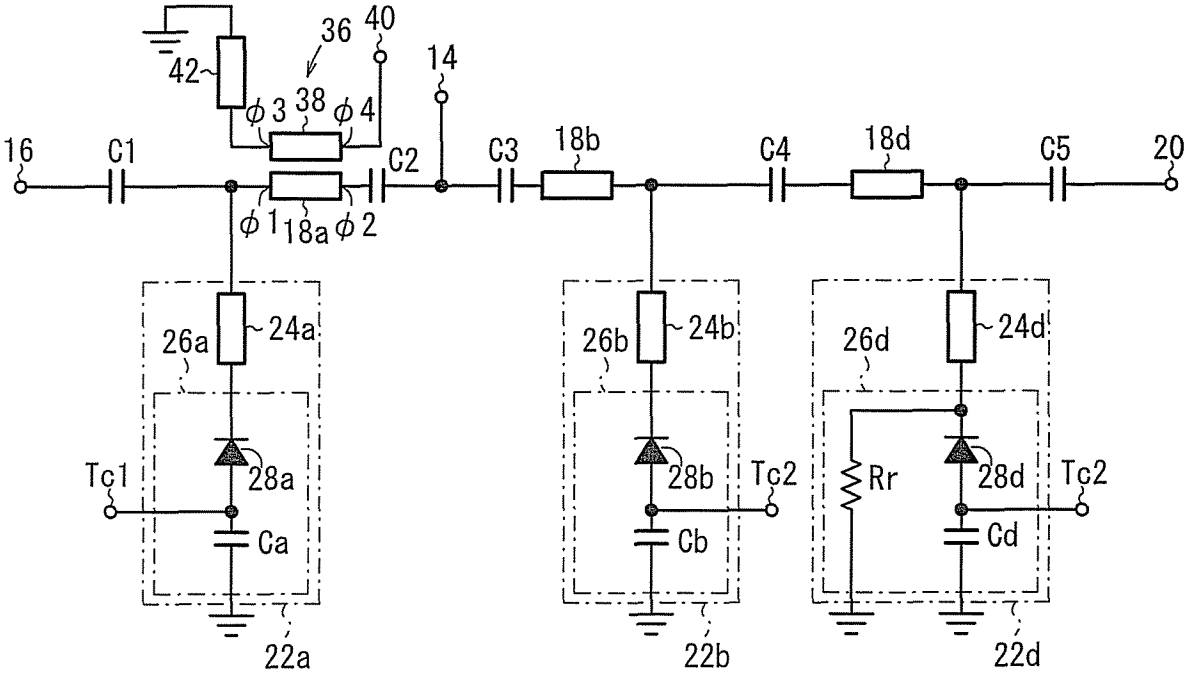
FIG. 15 is a circuit diagram showing a configuration of a sixth antenna switch.

An antenna switch according to a sixth embodiment (hereinafter referred to as a sixth antenna switch 10F) will be described below with reference to FIG. 15.

The sixth antenna switch 10F is of a configuration which is substantially similar to the fourth antenna switch 10D described above, but has a first switch circuit 22*a*, a second switch circuit 22*b*, and a fourth switch circuit 22*d* which are different therefrom in configuration as follows:

The first switch circuit 22*a* comprises the series-connected circuit of the first PIN diode 28*a* and the first capacitor Ca, connected between the first λ/4 transmission line 24*a* and GND, and the first control terminal Tc1 connected to the junction between the first PIN diode 28*a* and the first capacitor Ca.

The second switch circuit 22*b* comprises a series-connected circuit of the second PIN diode 28*b* and the second capacitor Cb, connected between the second λ/4 transmission line 24*b* and GND, and the second control terminal Tc2 connected to the junction between the second PIN diode 28*b* and the second capacitor Cb.

The fourth switch circuit 22*d* comprises a series-connected circuit of the fourth PIN diode 28*d* and the fourth capacitor Cd, connected between the fourth λ/4 transmission line 24*d* and GND, the second control terminal Tc2 connected to the junction between the fourth PIN diode 28*d* and the fourth capacitor Cd, and the resistor Rr for forming a reception terminating resistance, connected between the cathode of the fourth PIN diode 28*d* and GND.

Therefore, when the forward bias voltage Vc1 is applied to the first control terminal Tc1, turning on the first PIN diode 28*a*, and the reverse bias voltage Vc2 is applied to the second control terminal Tc2, turning off the second PIN diode 28*b* and the fourth PIN diode 28*d*, the sixth antenna switch 10F is represented by the equivalent circuit shown in FIG. 12 wherein only the transmission terminal 16 is connected to the antenna connection terminal 14 at high frequencies, and a terminating resistor Re of, for example, 50 ohms is connected to the reception terminal 20. In this case, the impedance on the receiver side when the switch is turned off is of the value of the terminating resistor Re, e.g., 50 ohms, thereby allowing the sixth antenna switch 10F to achieve impedance matching with other circuits. Therefore, the reception amplifier connected to the reception terminal 20 is rendered stable in operation.

Conversely, when the reverse bias voltage Vc2 is applied to the first control terminal Tc1, turning off the first PIN diode 28*a*, and the forward bias voltage Vc1 is applied to the second control terminal Tc2, turning on the second PIN diode 28*b* and the fourth PIN diode 28*d*, the sixth antenna switch 10F is represented by the equivalent circuit shown in FIG. 7 wherein only the reception terminal 20 is connected to the antenna connection terminal 14 at high frequencies.

As with the fourth antenna switch 10D, the sixth antenna switch 10F comprises the directional coupler 36 having the first λ/4 signal transmission line 18*a* as a component thereof. Thus, a signal in proportion to the reflected wave electric power Pb is output from the reflected wave output terminal 40 that is connected to the fourth end ϕ4 of the directional coupler 36. Accordingly, the reflected wave can be detected.

The equivalent circuit of the sixth antenna switch 10F in the vicinity of the central frequency fo when the first PIN diode 28*a* is turned off, is not the same as shown in FIG. 4B, but includes a parasitic capacitance Cf which remains as shown in FIG. 3B, thereby shifting the resonant frequency into a low frequency range. Thus, the sixth antenna switch 10F is poorer in performance than the fourth antenna switch 10D. However, since the sixth antenna switch 10F is structurally simple, it is effective in applications where small size and lower cost are preferable to performance.

Figure 16:
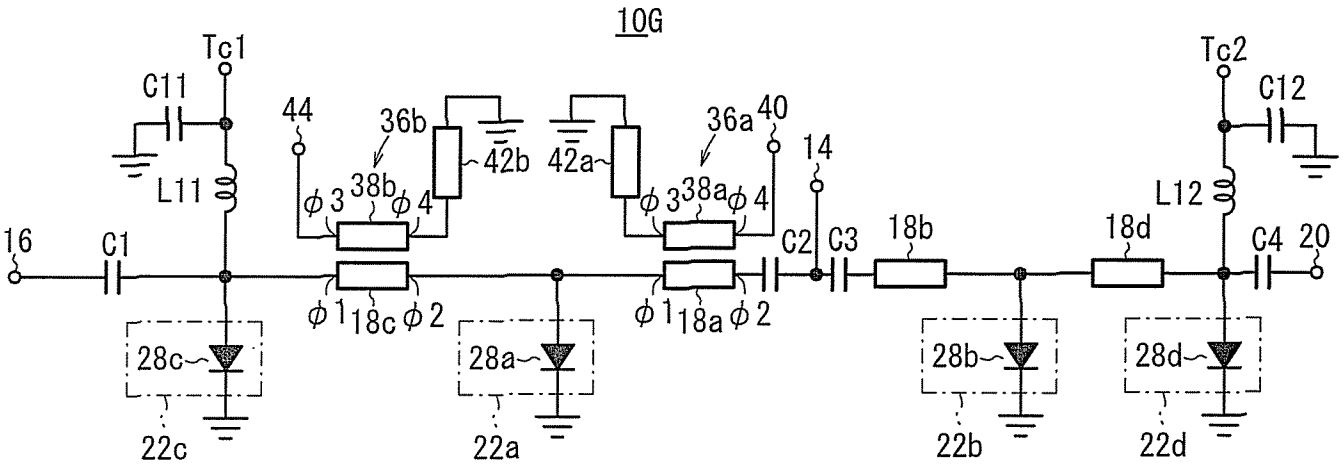
FIG. 16 is a circuit diagram showing a configuration of a seventh antenna switch.
Figure 17:
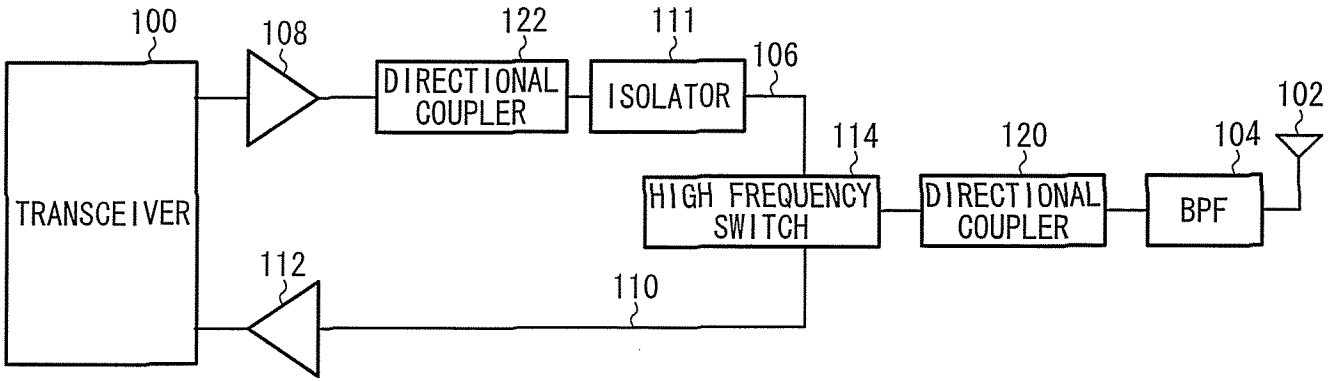
FIG. 17 is a diagram illustrative of a first transmission and reception switching scheme using a high frequency switch.
Figure 18:
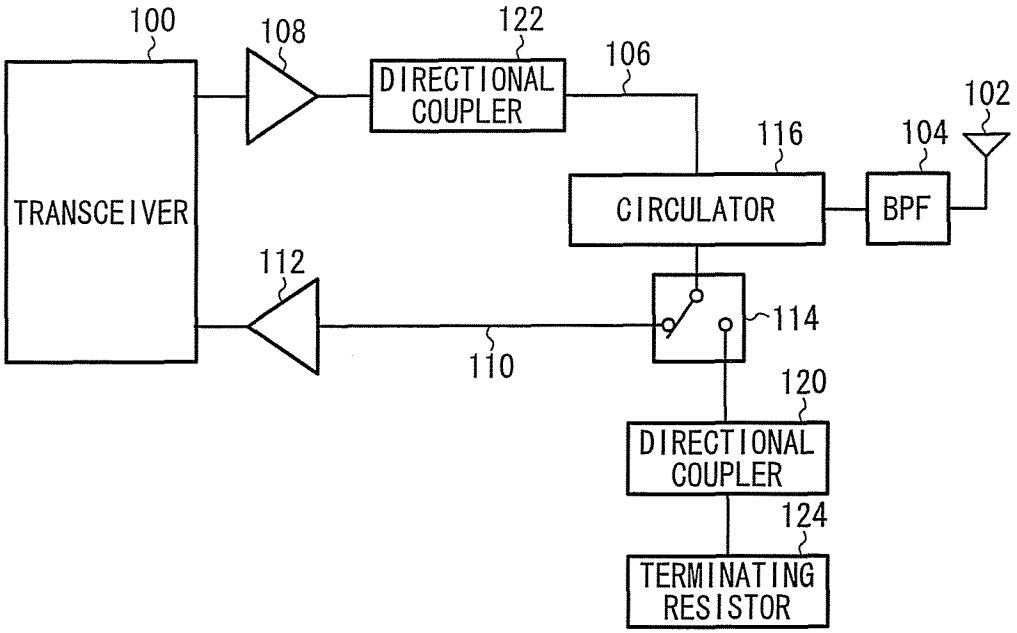
FIG. 18 is a diagram illustrative of a second transmission and reception switching scheme using a high frequency switch.

An antenna switch according to a seventh embodiment (hereinafter referred to as a seventh antenna switch 10G) will be described below with reference to FIG. 16.

The seventh antenna switch 10G is of a configuration including the first directional coupler 36*a* and the second directional coupler 36*b* that are connected to a conventional antenna switch.

The seventh antenna switch 10G has the first λ/4 signal transmission line 18*a* and the third λ/4 signal transmission line 18*c* that are connected between the transmission terminal 16 and the antenna connection terminal 14, a first switch circuit 22*a* of the first PIN diode 28*a* that is connected parallel to the first λ/4 signal transmission line 18*a*, and a third switch circuit 22*c* of the third PIN diode 28*c* that is connected parallel to the third λ/4 signal transmission line 18*c*.

Similarly, the seventh antenna switch 10G has the second λ/4 signal transmission line 18*b* and the fourth λ/4 signal transmission line 18*d* that are connected between the reception terminal 20 and the antenna connection terminal 14, a second switch circuit 22*b* of the second PIN diode 28*b* that is connected parallel to the second λ/4 signal transmission line 18*b*, and a fourth switch circuit 22*d* of the fourth PIN diode 28*d* that is connected parallel to the fourth λ/4 signal transmission line 18*d*.

Each of the first through fourth PIN diodes 28*a* through 28*d* is grounded at the cathode side.

The first control terminal Tc1 is connected to a signal line between the capacitor C1 on the transmitter side and the third λ/4 signal transmission line 18*c*, through an inductance element L11. A capacitor C11 is connected between the first control terminal Tc1 and GND. Similarly, the second control terminal Tc2 is connected to a signal line between the capacitor C4 on the receiver side and the fourth λ/4 signal transmission line 18*d*, through an inductance element L12. A capacitor C12 is connected between the second control terminal Tc2 and GND.

The seventh antenna switch 10G comprises the first directional coupler 36*a* and the second directional coupler 36*b*. The first directional coupler 36*a* has the first λ/4 signal transmission line 18*a* as a component thereof, for detecting a reflected wave of a transmission signal. The second directional coupler 36*b* has the third λ/4 signal transmission line 18*c* as a component thereof, for detecting a travelling wave of a transmission signal.

Thus, a signal in proportion to the travelling wave electric power Pa is output from the travelling wave output terminal 44 connected to the third end ϕ3 of the second directional coupler 36*b*. Also, a signal in proportion to the reflected wave electric power Pb is output from the reflected wave output terminal 40 connected to the fourth end ϕ4 of the first directional coupler 36*a*. Therefore, a reflected wave and a travelling wave of a transmission signal can be detected.

Accordingly, it is only necessary that the λ/4 line is disposed so as to face the λ/4 signal transmission line of the conventional antenna switch. Therefore, an antenna switch can be configured for detecting a reflected wave and a travelling wave of a transmission signal without increasing the number of parts used.

In the embodiments as described above, though the first through fourth λ/4 signal transmission lines 18*a* through 18*d* are used, which are advantageous particularly to reduction in size, 3λ/4 signal transmission lines may be used instead. Further, though the embodiments described above use the λ/4 line 38, the first λ/4 line 38*a*, or the second λ/4 line 38*b* for various lines, 3λ/4 lines etc. may be used instead in accordance with signal transmission lines. Also, though the embodiments described above use the first through fourth λ/4 transmission lines 24*a* through 24*d* are used, which are advantageous particularly to reduction in size for various transmission lines, 3λ/4 signal lines etc. may be used instead.

The high frequency switch according to the present invention is not limited to the above embodiments, but may adopt various configurations without departing from the scope of the invention.

The invention claimed is:

1. A high frequency switch including a first switch circuit connected parallel to a first signal transmission line for transmitting a transmission signal from a transmission terminal, and a second switch circuit connected parallel to a second signal transmission line for transmitting a reception signal to a reception terminal, the high frequency switch comprising:

a directional coupler having the first signal transmission line as a component thereof, for detecting at least a reflected wave of the transmission signal.

2. A high frequency switch according to claim 1, wherein the directional coupler further comprises:

a line disposed so as to face the first signal transmission line;

a reflected wave output terminal connected to one end of the line; and a terminating resistor connected to another end of the line.

3. A high frequency switch according to claim 2, wherein the line comprises a λ/4 line.

4. A high frequency switch according to claim 1, wherein a third switch circuit is connected parallel to a third signal transmission line connected between the transmission terminal and the first signal transmission line, the high frequency switch further comprising a second directional coupler having the third signal transmission line as a component thereof, for detecting at least a travelling wave of the transmission signal.

5. A high frequency switch according to claim 4, wherein the directional coupler further comprises:

a first line disposed so as to face the first signal transmission line;

a reflected wave output terminal connected to one end of the first line; and a terminating resistor connected to another end of the first line, the second directional coupler further comprises:

a second line disposed so as to face the third signal transmission line;

a travelling wave output terminal connected to one end of the second line; and a second terminating resistor connected to another end of the second line.

6. A high frequency switch according to claim 5, wherein each of the first and the second line comprises a λ/4 line.

7. A high frequency switch according to claim 4, wherein the third switch circuit comprises a third transmission line and a circuit including one or more third PIN diode, the third transmission line and the circuit being connected in series to each other.

8. A high frequency switch according to claim 7, wherein the third transmission line comprises a λ/4 transmission line.

9. A high frequency switch according to claim 4, wherein each of the first signal transmission line, the second signal transmission line and the third signal transmission line comprises a λ/4 signal transmission line.

10. A high frequency switch according to claim 1, wherein the directional coupler detects the reflected wave and a travelling wave of the transmission signal.

11. A high frequency switch according to claim 10, wherein the directional coupler further comprises:

a line disposed so as to face the first signal transmission line;

a reflected wave output terminal connected to one end of the line; and a travelling wave output terminal connected to another end of the line.

12. A high frequency switch according to claim 11, wherein the line comprises a λ/4 line.

13. A high frequency switch according to claim 1, wherein the first switch circuit comprises a first transmission line and a circuit including one or more first PIN diode, the first transmission line and the circuit being connected in series to each other, and wherein the second switch circuit comprises a second transmission line and a circuit including one or more second PIN diode, the second transmission line and the circuit being connected in series to each other.

14. A high frequency switch according to claim 13, wherein each of the first transmission line and the second transmission line comprises a λ/4 transmission line.

15. A high frequency switch according to claim 1, wherein each of the first signal transmission line and the second signal transmission line comprises a λ/4 signal transmission line.

* * * * *